United States Patent [19]

Smith

[11] 4,235,702

[45] Nov. 25, 1980

[54] HYDROCARBON PROCESSING

[75] Inventor: Robert D. Smith, Middlesbrough, England

[73] Assignee: Imperial Chemical Industries Limited, London, England

[21] Appl. No.: 969,829

[22] Filed: Dec. 15, 1978

[30] Foreign Application Priority Data

Dec. 20, 1977 [GB] United Kingdom ..... 52972/77

[51] Int. Cl.[3] ..... C07C 4/04; C10G 55/04

[52] U.S. Cl. ..... 208/87; 208/130; 585/650; 585/652

[58] Field of Search ..... 208/86, 87, 130; 585/650, 652

[56] References Cited

U.S. PATENT DOCUMENTS

| | | | |
|---|---|---|---|
| 2,937,135 | 5/1960 | Middlelton | 208/86 |
| 3,288,703 | 11/1966 | Spars et al. | 208/86 |
| 3,507,777 | 4/1970 | Hemminger | 208/86 |
| 3,922,216 | 11/1975 | Wilson et al. | 208/130 |

FOREIGN PATENT DOCUMENTS

| | | | |
|---|---|---|---|
| 1248814 | 10/1971 | United Kingdom | 208/87 |

*Primary Examiner*—Herbert Levine

*Attorney, Agent, or Firm*—Cushman, Darby & Cushman

[57] ABSTRACT

The process relates to the production of olefins by thermal cracking, in the absence of a catalyst, of a fuel value residual hydrocarbon feedstock which, prior to cracking, is extracted with a paraffinic solvent which is selective for the saturated hydrocarbon material present in the feedstock. Preferred extraction conditions include the use of supercritical temperatures and pressures. The solvent is separated from the extracted hydrocarbon material and the latter is then cracked.

9 Claims, No Drawings

HYDROCARBON PROCESSING

This invention concerns processes for the thermal pyrolysis, or "cracking", of hydrocarbon feedstocks and more especially the invention concerns the cracking processes, normally using a process stream diluent, for example steam or hydrogen, in which a hydrocarbon mixture containing a substantial proportion of saturated hydrocarbons is pyrolysed in the absence of a catalyst in the course of passage through a radiantly heated furnace to produce lower molecular weight hydrocarbons including ethylene, propylene and butadiene.

In recent years, efforts have been directed towards increasing the ethylene yields which can be obtained from cracking processes. Methods employed have included, for example, the use of higher severity cracking furnaces and the use of a wider range of feedstocks. However, these efforts have not always been altogether successful. In the cracking process a number of reactions occur simultaneously, these reactions usually involving the formation and consumption of free radicals of one sort and another. As a result, a number of minor products including for example pyrolysis fuel oil, tend to be formed in addition to the principal products and the use of, for example, more severe conditions or a wider range of feedstocks, for example high-boiling feedstocks such as residua, tends to increase the production of these minor products, including fuel oil. Thus, one disadvantageous feature is the formation of what is termed "coke". This term embraces various carbonaceous deposits which are formed during hydrocarbon processing and which tend to accumulate on the walls of reactors, furnaces, piping and associated equipment. Eventually, the accumulation of coke deposits in, say, a process reactor begins to have significant and unacceptably deleterious effects on the efficiency of the process and it becomes necessary to remove the deposit either by stopping the process altogether or by switching the coked equipment out of the process sequence.

Disadvantageous features, such as the increased formation of coke or other side-products, have therefore tended to inhibit attempts to increase the output from thermal crackers. Feedstocks used have tended to be limited to well-proven feeds, for example light naphtha. We have now surprisingly found that it is possible to improve the production of olefins by using a residual feed which has been pretreated before being subject to thermal cracking.

Accordingly, the present invention is a process for thermally cracking a fuel value residual hydrocarbon feedstock in the absence of a catalyst which comprises solvent extracting the hydrocarbon feedstock with a paraffinic hydrocarbon solvent which is selective for the saturated hydrocarbon material present in the feedstock, separating the paraffinic hydrocarbon solvent from the extracted hydrocarbon material and thermally cracking the extracted hydrocarbon material in a pyrolysis furnace in the presence of a process stream diluent.

Fuel value residual hydrocarbon feedstocks are those residua, common to almost all petroleum refining, which remain after the much more useful lighter and middle distillates have been removed from the crude. These residua have found a limited use as fuels or in road or building operations but generally it has proved very difficult to put them to valuable use. Depending on their source, residua contain greater or lesser amounts of paraffins, cyclo-paraffins, polycyclic paraffins, aromatic hydrocarbons, polyaromatic hydrocarbons, asphaltenes as well as amounts of metals, resins, sulphur and nitrogen compounds. Preferred feedstocks include the atmospheric residuum and the vacuum residuum from crude oil distillation.

In the process of this invention, the compounds, for example paraffins which are suitable for thermal cracking to olefins are extracted using a paraffinic hydrocarbon solvent which selectively extracts these compounds but which is non-selective for unwanted components of the residuum, for example metal compounds, aromatic hydrocarbons. In practice, it is very difficult to obtain a perfect separation of wanted components from unwanted components. The extractant phase will contain most of the desired components, for example paraffins, as well as smaller amounts of unwanted components, for example aromatics and polycyclic aromatics. The raffinate phase will contain most of these unwanted components as well as small amounts of the wanted components. Preferably, the solvent is a light paraffinic hydrocarbon containing 6 or less hydrocarbon atoms, for example n-pentane. The amount of hydrocarbon solvent relative to the amount of feedstock which is needed for any particular feedstock will depend to some extent on the origin of that feedstock but those skilled in this art should have little difficulty in rapidly ascertaining the optimum amount of solvent for any particular feedstock. Solvent extraction of the saturated hydrocarbon material in the feedstock may be helped in certain circumstances, for example when the potential solvent is gaseous at ambient conditions, by the use of supercritical conditions in which the operating pressure is significantly above, for example at least 500 p.s.i.g. above, the critical pressure of the solvent and in which the operating temperature is significantly above the critical temperature of the solvent.

Separation of the solvent from the hydrocarbon extract is conveniently effected by distillation or, if the solvent extraction was effected under supercritical conditions, by flashing off the solvent. The extract is then passed to the pyrolysis furnace for cracking. Small amounts of paraffinic solvent which may be retained in the extract are readily tolerable and will also be cracked to useful products. If desired, the extract can be blended with a conventional cracking feedstock, for example naphtha, immediately prior to the cracking stage of the process.

Conditions used in the cracking stage of the process are similar to those which are usually used in thermal cracking. Typically, a process stream diluent, for example steam or hydrogen, is mixed with the hydrocarbon feed and passed through conduits ("cracking coils") in a furnace, the temperature in the radiant zone of the furnace will usually lie in the range 750° to 850° C. Alternatively, the thermal cracking stage may be effected using a furnace in which internal combustion rather than radiant heating is used to provide the heat for the cracking reaction.

We have found that the use of the process of this invention produces less low-value pyrolysis fuel oil than a proposed alternative method in which a residual feedstock is vacuum distilled (instead of being solvent extracted) to produce a vacuum gas oil which is then cracked.

In a typical embodiment of this invention, the feedstock would be the 30% residuum of crude oil, obtained by the vacuum removal of volatiles to an equivalent atmospheric boiling point of 480° C. It would be extracted countercurrently with propane at 100° C. and 700 p.s.i.g., to yield 24% of an extract of enhanced paraffin content. The extract would be mixed with steam (steam/oil ratio 0.8:1), and cracked at 770°–790° C. to give approximately 20% ethylene, with coproducts.

I claim:

1. A process for thermally cracking a fuel value residual hydrocarbon feedstock containing a substantial proportion of saturated hydrocarbons in the absence of a catalyst which comprises solvent extracting the hydrocarbon feedstock with a paraffinic hydrocarbon solvent which is selective for the saturated hydrocarbon material present in the feedstock, separating the paraffinic hydrocarbon solvent from the extracted hydrocarbon material and thermally cracking the extracted hydrocarbon material in a pyrolysis furnace in the presence of a process stream diluent to produce lower molecular weight olefinic hydrocarbons, the process stream diluent comprising steam and the thermal cracking stage of the process being effected at a cracking temperature of at least 750° C.

2. A process as claimed in claim 1 in which the residual hydrocarbon feedstock is an atmospheric residuum or a vacuum residuum from crude oil distillation.

3. A process as claimed in claim 1 in which the paraffinic hydrocarbon solvent is a light paraffinic hydrocarbon containing 6 or less hydrocarbon atoms.

4. A process as claimed in claim 3 in which the paraffinic hydrocarbon solvent is n-pentane.

5. A process as claimed in claim 1 in which the solvent extraction is carried out at a temperature above the critical temperature of the solvent and at a pressure above the critical pressure of the solvent.

6. A process as claimed in claim 5 in which the pressure is at least 500 p.s.i.g. above the critical pressure of the solvent.

7. A process as claimed in claim 1 in which the extracted hydrocarbon material is blended with a conventional thermal cracking feedstock immediately prior to the cracking stage of the process.

8. A process as claimed in claim 1 in which the thermal cracking stage of the process is effected in a cracking coil and at a cracking temperature in the range 750° to 850° C.

9. A process as claimed in claim 1, wherein said residua hydrocarbon feedstock consists essentially of residual which remain after lighter and middle distillates have been removed from a crude feedstock during petroleum refining, said residua comprising paraffinic hydrocarbons and at least one non-paraffinic component selected from the group consisting of aromatic hydrocarbons, polyaromatic hydrocarbons, asphaltenes, metals, resins, sulphur compounds and nitrogen compounds.

* * * * *